US009259607B2

(12) United States Patent
Kokenis et al.

(10) Patent No.: US 9,259,607 B2
(45) Date of Patent: Feb. 16, 2016

(54) CORE MUSCLE EXERCISE DEVICE

(71) Applicants: Louis J. Kokenis, Arnold, MO (US); Barot A. Ghasedi, St. Louis, MO (US)

(72) Inventors: Louis J. Kokenis, Arnold, MO (US); Barot A. Ghasedi, St. Louis, MO (US)

( * ) Notice: Subject to any disclaimer, the term of this patent is extended or adjusted under 35 U.S.C. 154(b) by 184 days.

(21) Appl. No.: 13/911,232

(22) Filed: Jun. 6, 2013

(65) Prior Publication Data

US 2013/0337977 A1 Dec. 19, 2013

Related U.S. Application Data

(60) Provisional application No. 61/660,946, filed on Jun. 18, 2012.

(51) Int. Cl.

| | |
|---|---|
| ***A63B 21/22*** | (2006.01) |
| ***A63B 21/06*** | (2006.01) |
| ***A63B 24/00*** | (2006.01) |
| ***A63B 21/00*** | (2006.01) |
| ***A63B 23/035*** | (2006.01) |
| ***A63B 23/12*** | (2006.01) |
| *A63B 23/04* | (2006.01) |

(52) U.S. Cl.

CPC ..... *A63B 21/0608* (2013.01); *A63B 21/0004* (2013.01); *A63B 21/00061* (2013.01); *A63B 21/1469* (2013.01); *A63B 21/22* (2013.01); *A63B 23/03525* (2013.01); *A63B 23/1245* (2013.01); *A63B 24/00* (2013.01); *A63B 23/0405* (2013.01); *A63B 2220/17* (2013.01)

(58) Field of Classification Search

CPC ..... A63B 2021/222; A63B 19/00; A63B 21/0004; A63B 21/00061; A63B 21/00065; A63B 21/06; A63B 21/0601; A63B 21/0608; A63B 21/1446; A63B 21/1465; A63B 21/1484; A63B 24/00; A63B 24/0062

See application file for complete search history.

(56) References Cited

U.S. PATENT DOCUMENTS

| | | | | |
|---|---|---|---|---|
| 4,356,915 | A * | 11/1982 | Phillips | B65D 85/58 206/315.1 |
| 5,674,162 | A * | 10/1997 | Ellingson et al. | 482/110 |
| 6,500,102 | B1 * | 12/2002 | Domenge | 482/110 |

* cited by examiner

*Primary Examiner* — Loan H Thanh
*Assistant Examiner* — Rae Fischer
(74) *Attorney, Agent, or Firm* — Buckingham, Doolittle & Burroughs, LLC

(57) ABSTRACT

An exercise device is disclosed that provides users with a way to effectively exercise their core muscles without going to a gym. The exercise device comprises a round tube, a pair of handles secured to the round tube, and at least one sphere inserted into the round tube, wherein a user rotates the exercise device in a circular motion causing the sphere to travel around the round tube. The round tube comprises an interior cavity with an internal track system for the spheres to travel. Typically, the spheres are weighted, and the exercise device comprises a plurality of spheres each of a different weight. Furthermore, the round tube can comprise an access panel positioned on the exterior surface of the round tube for inserting a sphere, and a pair of handles that span an inner diameter of the round tube and are secured to opposing sides of the round tube.

15 Claims, 4 Drawing Sheets

CORE MUSCLE EXERCISE DEVICE

CROSS-REFERENCE

This application claims priority from Provisional Patent Application Ser. No. 61/660,946 filed Jun. 18, 2012.

BACKGROUND

The core muscles in the torso help stabilize the spine and pelvis. These muscles are important, yet commonly neglected, as many people lack the time and energy required to go to the gym every day. A weak core can lead to poor posture, lower back pain and overall physical weakness. A solution is needed to allow users to work out these core muscles quickly and efficiently at home, whenever convenient.

The present invention allows users to get an effective core workout in the comfort of their own home. The exercise device comprises a round, hollow tube (i.e., doughnut-shaped), wherein a weighted sphere can be placed inside the tube, and the user rotates the sphere around the tube to work their core muscles. Users may also incorporate squats or lunges while using the exercise device. The exercise device can be used at home, or the device can easily be taken anywhere a user goes. Anyone who wants an effective core workout without going to the gym and without the need to purchase expensive exercise equipment may appreciate this unique invention.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises an exercise device that provides users with a way to effectively exercise their core muscles without going to a gym and without having to purchase expensive exercise equipment. The exercise device comprises a round, doughnut-shaped tube, a pair of handles secured to the round tube, and at least one sphere inserted into the round tube, wherein a user rotates the exercise device in a circular motion causing the sphere to travel around the inside circumference of the tube. The round tube comprises an interior cavity with an internal track system for the spheres to travel. Typically, the spheres are weighted, and the exercise device comprises a plurality of spheres each of different weight. Furthermore, the round tube can comprise an access panel positioned on the exterior surface of the round tube for inserting a sphere or spheres. The exercise device also comprises a pair of handles that span an inner diameter of the round tube and are secured to opposing sides of the round tube.

In a preferred embodiment, the handles comprise padded grips of rubber or foam. Generally, a user grasps the handles of the exercise device and rotates the device in a generally circular motion, which causes the sphere inside the interior cavity to travel approximately 360 degrees around the interior cavity of the tube, creating rapid resistance through inertia. A user can also incorporate squats and/or lunges while rotating the device in a circular motion for additional exercise to the core muscles, as well as other muscles of the body. Further, the exercise device can comprise a digital hit counter secured to the exterior surface of the round tube to measure revolutions of the spheres.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
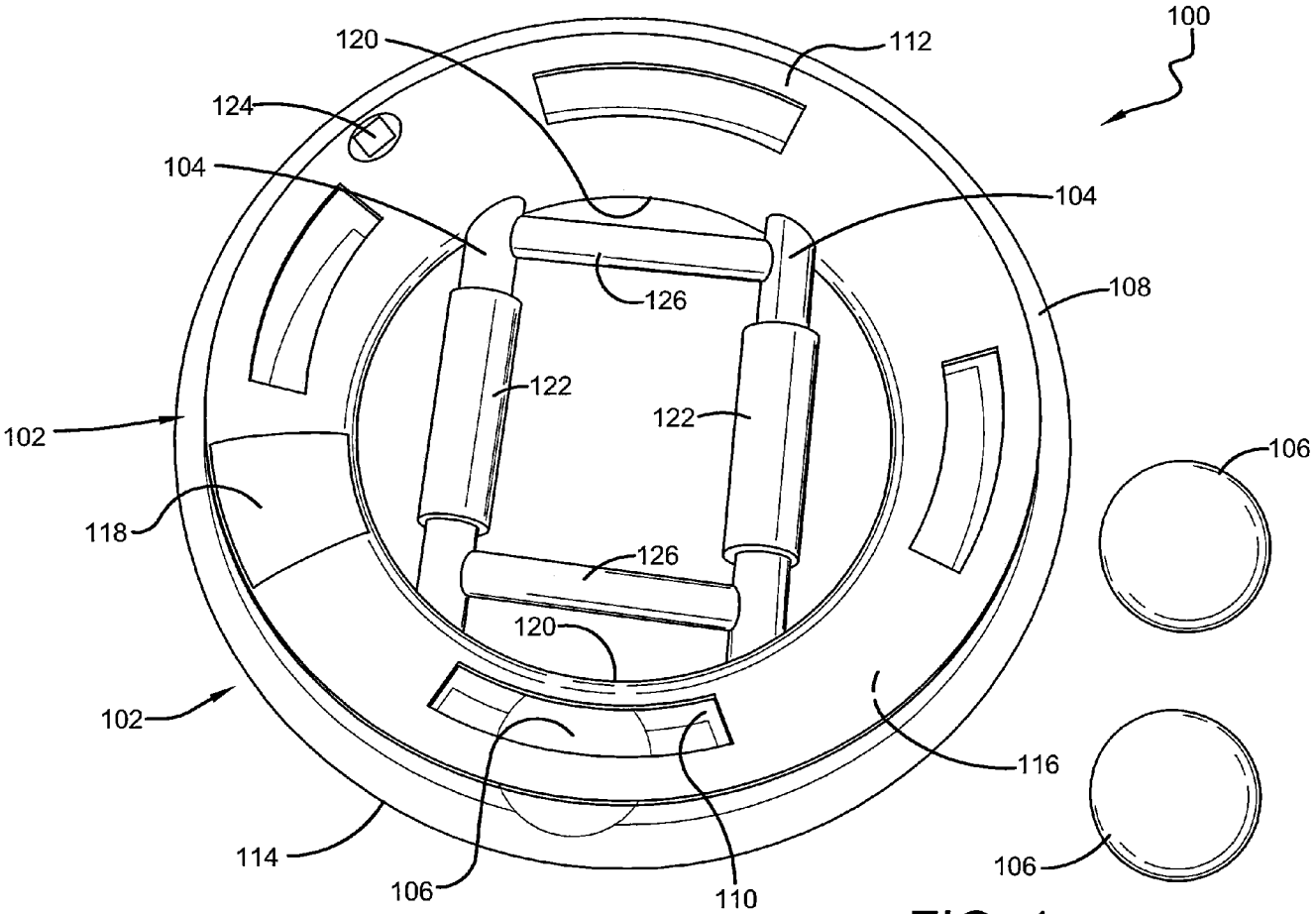
FIG. 1 illustrates a perspective view of the exercise device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention allows users to get an effective core workout in the comfort of their own home, whenever convenient. Users place a weighted sphere or spheres inside the exercise device and then rotate the sphere around the tube to work their core muscles. Users may also incorporate squats or lunges while using the exercise device. The exercise device can be used at home, or the device can easily be taken anywhere a user goes. Anyone who wants an effective core workout without going to the gym may appreciate this unique invention.

The disclosed exercise device comprises a round tube, a pair of handles secured to the round tube, and at least one sphere inserted into the round tube, wherein a user rotates the exercise device in a circular motion causing the sphere to travel around the round tube. The round tube comprises an interior cavity with an internal track system for the spheres to travel. Typically, the spheres are weighted, and the exercise device comprises a plurality of spheres each of a different weight. Furthermore, the round tube can comprise an access panel positioned on the exterior surface of the round tube for inserting the sphere(s), and a pair of handles that span an inner diameter of the round tube and are secured to opposing sides of the round tube.

Figure 2:
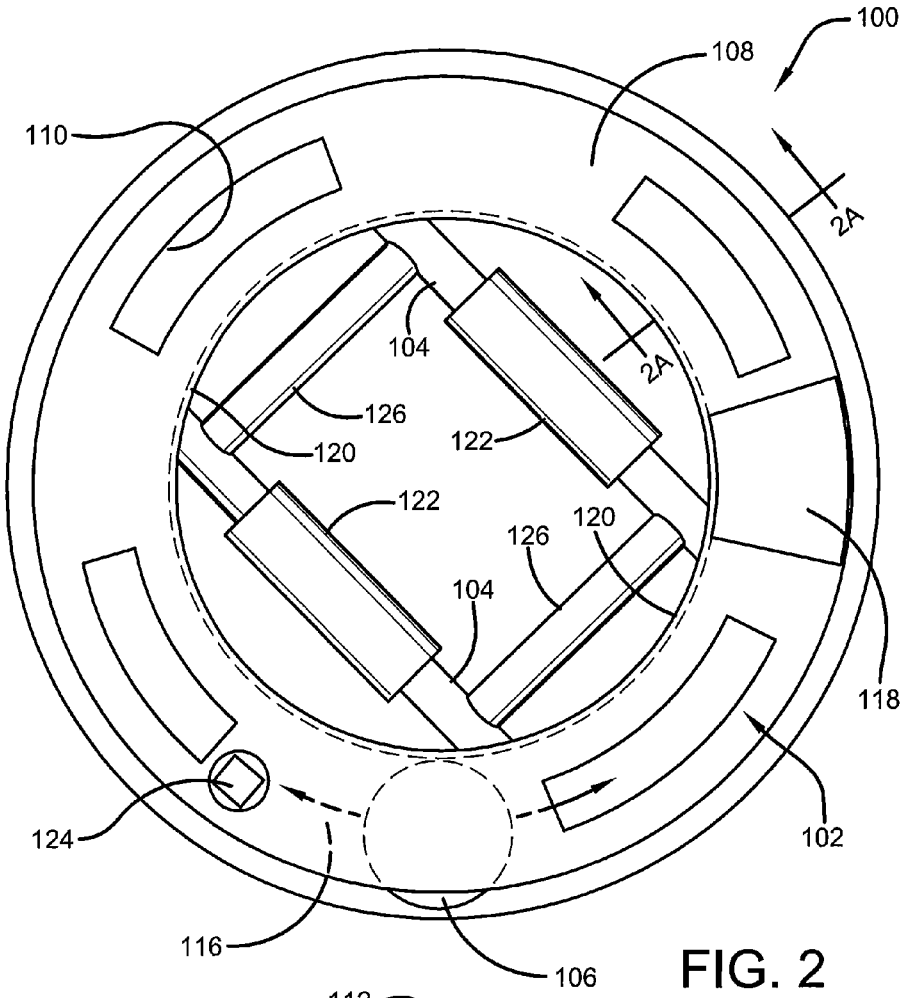
FIG. 2 illustrates a top perspective view of the exercise device with the sphere inserted into the round, hollow tube in accordance with the disclosed architecture.
Figure 2A:
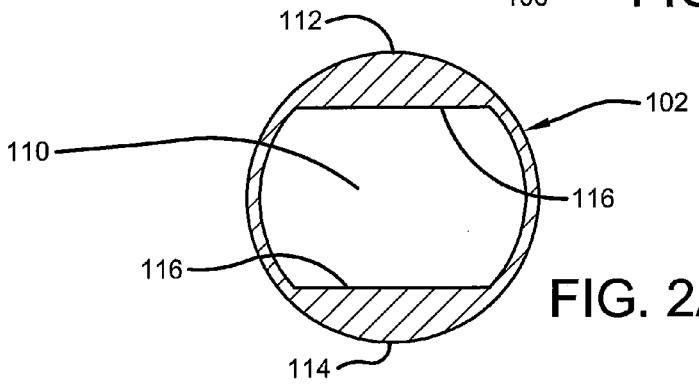
FIG. 2A illustrates a cross sectional view of the exercise device in accordance with the disclosed architecture.

Referring initially to the drawings, FIGS. 1-2 and 2A illustrate the exercise device 100 that provides users with a way to effectively exercise their core muscles without going to a gym. The exercise device 100 comprises a round tube 102, a pair of handles 104 secured to the round tube 102, and at least one sphere 106 inserted into the round tube 102, wherein a user (not shown) rotates the exercise device 100 in a generally circular motion causing the at least one sphere 106 to travel around the round tube 102 (as shown in FIG. 1).

The tube 102 comprises an exterior surface 108 and an interior cavity 110. Typically, the tube 102 is round, circular, and/or doughnut-shaped, however any other suitable shape can be used as is known in the art without affecting the overall concept of the invention. The round tube 102 is connected end to end to form a circular shape (i.e., doughnut shape, as shown in FIG. 2). The round tube 102 can be formed as an integral piece or formed as two halves perpendicular to the axis, which can be secured together via any suitable securing means as is known in the art such as welding, gluing, etc.

The round tube 102 would generally be constructed of aluminum or any other light-weight metal, polished chrome, high density durable plastics, clear plastics, etc., though any other suitable material may be used to manufacture the round tube 102 as is known in the art without affecting the overall concept of the invention.

The round tube 102 can also comprise a variety of colors and designs to suit user and manufacturing preference, and can be manufactured in a variety of sizes depending on the wants and needs of a user. The round tube 102 is approximately between 3 and 4 inches thick as measured from a top surface 112 to a bottom surface 114, and approximately between 10 and 12 inches in an inner diameter, and approximately between 15 and 17 inches in an outer diameter.

Typically, the round tube 102 is hollow, but it does not have to be and can function by being partly solid, as long as the round tube 102 forms an interior cavity 110, such that a sphere 106 inserted into the interior cavity 110 can travel approximately 360 degrees around the interior cavity 110 of the tube 102. Further, the round tube 102 can comprise an internal track 116 secured within the interior cavity 110 of the round, hollow tube 102. The internal track 116 allows the sphere 106 to easily and smoothly travel around the interior cavity 110 of the round, hollow tube 102.

Typically, the internal track 116 is a closed track. Specifically, on the inside of the closed tube 102 there is a slightly raised track 116 on both the inside top and inside bottom of the tube. This prevents the spheres 106 from rubbing on the inner tube, and helps the spheres 106 to glide smoothly.

Furthermore, the round tube 102 comprises an access panel 118 positioned on the exterior surface 108 of the round, hollow tube 102 for inserting a sphere 106. The access panel 118 is typically a hinged, sliding, or removable door or other suitable access means for inserting a sphere 106 as is known in the art. A user opens the access panel 118 and inserts or removes at least one sphere 106 into or from the interior cavity 110 of the round tube 102 and onto the internal track 116, and then secures the access panel 118 retaining the sphere 106 within the interior cavity 110.

The exercise device 100 further comprises at least one sphere 106 inserted into the interior cavity 110 of the round, hollow tube 102. Once inserted, the user rotates the exercise device 100 in a generally circular motion causing the at least one sphere 106 to travel around the interior cavity 110 of the round, hollow tube 102. Typically, the spheres 106 are weighted, and the exercise device 100 comprises a plurality of spheres 106 each of different weight. In a preferred embodiment, the exercise device 100 comprises three spheres 106 of different weights for a user to choose from. The spheres 106 are approximately between 2 and 3 inches in diameter. The spheres 106 can also comprise a variety of colors and designs to suit user and manufacturing preference, and can be manufactured in a variety of sizes depending on the wants and needs of a user. The spheres 106 would generally be constructed of an iron weighted core, a polypropylene outer shell, and a sound deadening coating, etc., though any other suitable material may be used to manufacture the spheres 106 as is known in the art without affecting the overall concept of the invention. The spheres 106 can be color coded according to weight. For example, yellow spheres indicate a beginner, blue spheres indicate an intermediate, and red spheres indicate an advanced user.

Furthermore, the exercise device 100 comprises a pair of handles 104. Typically, the handles 104 are used in pairs, but they do not have to be and the device 100 can function with only one handle 104, although the device 100 performs more efficiently with a pair of handles 104 (as shown in FIG. 1). The handles 104 are generally cylindrical rods that are secured to the round, hollow tube 102. Typically, the handles 104 span an inner diameter of the round, hollow tube 102 and are secured to opposing sides 120 of the round, hollow tube 102. However, the handles 104 can be positioned in any suitable position as is known in the art on the round, hollow tube 102. Further, the handles 104 can comprise supports 126 that are secured perpendicular to the handles 104 for added structural support (as shown in FIGS. 1 and 2).

Additionally, the handles 104 comprise padded grips 122. The padded grips 122 would generally be constructed of rubber or foam, etc., though any other suitable material may be used to manufacture the padded grips 122 as is known in the art without affecting the overall concept of the invention. Generally, a user grasps the handles 104 of the exercise device 100 and rotates the device 100 in a generally circular motion, which causes the sphere 106 inside the interior cavity 110 to travel approximately 360 degrees around the interior cavity 110 of the tube 102 (i.e. through centrifugal force), creating rapid resistance through inertia. Specifically, as the sphere 106 spins through the tube 102, it is constantly pulling away from the center point (i.e., centrifugal force). The resistance created is the inertia of motion experienced through the centrifugal force. A user can also incorporate squats and/or lunges while rotating the device 100 in a circular motion for additional exercise to the core muscles, as well as other muscles of the body.

The exercise device further comprises a digital hit counter 124 secured to the exterior surface 108 of the round, hollow tube 102. The digital hit counter 124 measures revolutions of the spheres 106 within the hollow tube 102. Specifically, the digital hit counter 124 senses each time the sphere 106 passes by the counter 124, and indicates that number on the digital screen facing the user. Typically, the digital hit counter 124 is secured on the top of the device 100, facing the user. However, the digital hit counter 124 can be secured to any suitable position on the exterior surface 108 of the round, hollow tube 102.

Figure 3:
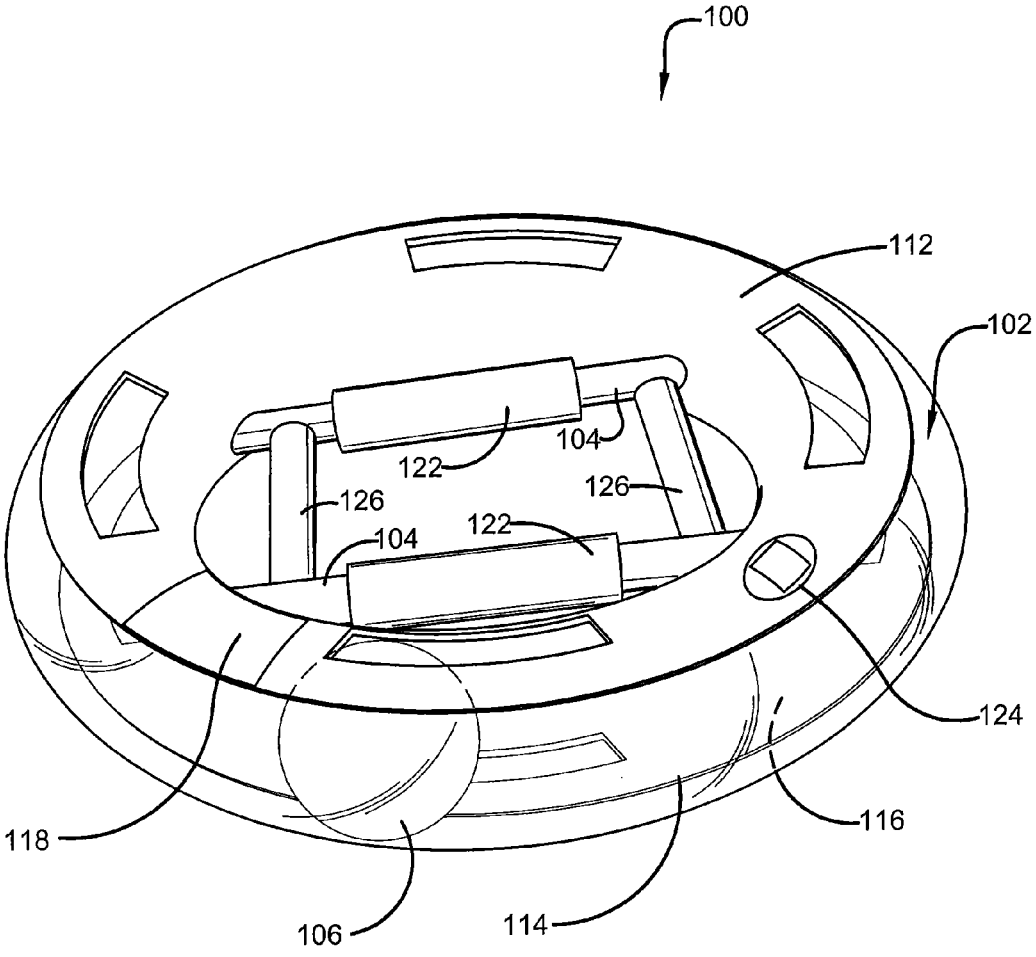
FIG. 3 illustrates a perspective view of the exercise device showing how the sphere travels around the round, hollow tube in accordance with the disclosed architecture.

FIG. 3 illustrates the exercise device 100 showing how the sphere 106 travels around the round, hollow tube 102. As stated supra, the round tube 102 comprises an internal track 116 secured within the interior cavity 110 of the round, hollow tube 102. The internal track 116 allows the sphere 106 to easily and smoothly travel around the interior cavity 110 of the round, hollow tube 102. Specifically, a user inserts a sphere 106 into the interior cavity 110 of the round, hollow tube 102. The user then grasps the handles 104 of the exercise device 100 and rotates the device 100 in a circular motion, which causes the sphere 106 inside the interior cavity 110 to travel approximately 360 degrees around the interior cavity 110 of the tube 102 along the internal track 116, creating rapid resistance through inertia. A user can also incorporate squats and/or lunges while rotating the device 100 in a circular motion for additional exercise to the core muscles, as well as other muscles of the body.

Figure 4:
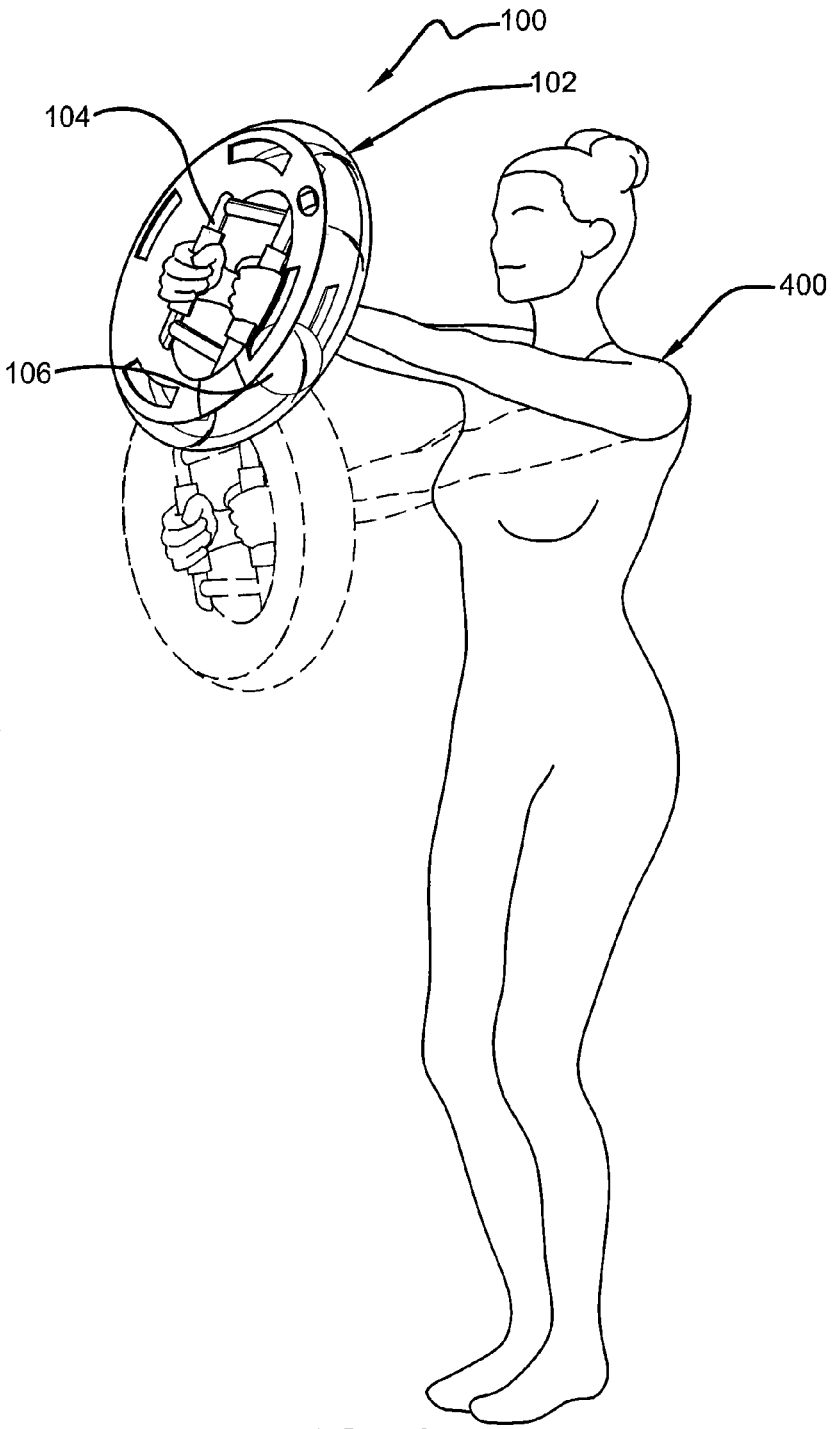
FIG. 4 illustrates a perspective view of the exercise device in use in accordance with the disclosed architecture.

FIG. 4 illustrates the exercise device 100 in use. In operation, a user 400 would choose the color and/or specific design of the exercise device 100, as well as the specific size of the exercise device 100 that meets their needs and/or wants. The user 400 would then determine what weighted sphere 106 to insert into the exercise device 100. A plurality of spheres 106 would be available to the user 400 wherein each of the spheres 106 would have a different weight. The user 400 can choose multiple spheres 106 to insert into the exercise device 100 or the user 400 can insert a single sphere 106 into the exercise device depending on their needs and/or wants. Specifically, the user 400 would open the access panel 118 on the round tube 102 of the exercise device 100 and would insert the sphere 106 directly into the interior cavity 110 of the round tube 102. The interior cavity 110 comprises an internal track 116 that for the spheres 106 to travel.

Once the desired sphere 106 and desired number of spheres 106 are inserted into the interior cavity 110 of the round tube 102, the user 400 closes the access panel 118 and secures it. The user 400 then grasps the handles 104 of the exercise device 100 and rotates the device 100 in a circular motion, which causes the sphere 106 inside the interior cavity 110 to travel approximately 360 degrees around the interior cavity 110 of the tube 102 (i.e. through centrifugal force), creating rapid resistance through inertia. The user 400 can also incorporate squats and/or lunges while rotating the device 100 in a circular motion for additional exercise to the core muscles, as well as other muscles of the body. The user 400 can then keep track of the revolutions of the sphere 106 via turning on the digital hit counter 124 which is secured to the exterior surface 108 of the round, hollow tube 102.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An exercise device comprising:

a generally round, hollow tube comprising an exterior surface and an interior cavity and formed into a circular shape;

a pair of handles secured to the generally round, hollow tube, wherein each handle spans the interior of the circular shape and is secured to opposing sides of the interior of the circular shape;

a pair of supports secured between and perpendicular to the pair of handles for added structural support;

at least one sphere which is inserted into the interior cavity of the generally round, hollow tube; and an internal track secured within the interior cavity of the generally round, hollow tube, wherein the internal track is secured on both the inside top and the inside bottom of the hollow tube, this prevents the at least one sphere from rubbing on the interior cavity and helps the at least one sphere to glide smoothly on the internal track around the interior cavity of the hollow tube;

wherein the exercise device is capable of being rotated by a user in a generally circular motion causing the at least one sphere to travel around the interior cavity of the generally round, hollow tube.

2. The exercise device of claim 1, further comprising an access panel positioned on the exterior surface of the generally round, hollow tube for inserting the at least one sphere into the interior cavity.

3. The exercise device of claim 1, wherein the at least one sphere comprises an iron weighted core.

4. The exercise device of claim 1, further comprising a plurality of spheres, wherein the plurality of spheres each comprise a different weight.

5. The exercise device of claim 1, wherein the pair of handles comprise padded grips.

6. The exercise device of claim 5, wherein the padded grips comprise rubber or foam.

7. The exercise device of claim 1, further comprising a digital hit counter secured to the exterior surface of the generally round, hollow tube to measure revolutions of the at least one sphere within the interior cavity.

8. An exercise device comprising:

a generally round, hollow tube comprising an exterior surface and an interior cavity and formed into a circular shape;

a pair of handles secured to the generally round, hollow tube, wherein each handle spans the interior of the circular shape and is secured to opposing sides of the interior of the circular shape;

a pair of supports secured between and perpendicular to the pair of handles for added structural support;

at least one weighted sphere with an iron weighted core, which is inserted into the interior cavity of the generally round, hollow tube;

an access panel positioned on the exterior surface of the generally round, hollow tube for inserting the at least one weighted sphere into the interior cavity; and an internal track secured within the interior cavity of the generally round, hollow tube, wherein the internal track is secured on both the inside top and the inside bottom of the hollow tube, this prevents the at least one sphere from rubbing on the interior cavity and helps the at least one sphere to glide smoothly on the internal track around the interior cavity of the hollow tube;

wherein, once the at least one weighted sphere is inserted into the interior cavity, the exercise device is capable of being rotated by a user in a generally circular motion causing the at least one weighted sphere to travel around the interior cavity of the generally round, hollow tube.

9. The exercise device of claim 8, wherein the pair of handles comprise padded grips.

10. The exercise device of claim 9, wherein the padded grips comprise rubber or foam.

11. The exercise device of claim 8, further comprising a plurality of weighted spheres, wherein the plurality of weighted spheres each comprise a different weight.

12. The exercise device of claim 8, further comprising a digital hit counter secured to the exterior surface of the generally round, hollow tube to measure revolutions of the at least one weighted sphere.

13. An exercise device comprising:

a generally round, hollow tube comprising an exterior surface and an interior cavity and formed into a circular shape;

a pair of handles secured to the generally round, hollow tube, wherein each handle spans the interior of the circular shape and is secured to opposing sides of the interior of the circular shape;

a pair of supports secured between and perpendicular to the pair of handles for added structural support;

a plurality of weighted spheres which are color coded according to weight, wherein only one weighted sphere is inserted into the interior cavity of the generally round, hollow tube at a time;

an access panel positioned on the exterior surface of the generally round, hollow tube for inserting the at least one weighted sphere into the interior cavity; and an internal track secured within the interior cavity of the generally round, hollow tube, wherein the internal track is secured on both the inside top and the inside bottom of the hollow tube, this prevents the one sphere from rubbing on the interior cavity and helps the one sphere to glide smoothly on the internal track around the interior cavity of the hollow tube;

wherein, once the at least one weighted sphere is inserted into the interior cavity on the internal track, the exercise device is capable of being rotated by a user in a generally circular motion causing the inserted weighted sphere to travel around the internal track of the generally round, hollow tube.

14. The exercise device of claim 13, wherein the pair of handles comprise padded grips.

15. The exercise device of claim 13, further comprising a digital hit counter secured to the exterior surface of the generally round, hollow tube to measure revolutions of the inserted weighted sphere.

* * * * *